US006595654B2

(12) United States Patent
Washburn

(10) Patent No.: US 6,595,654 B2
(45) Date of Patent: Jul. 22, 2003

(54) MULTIFUNCTIONAL ILLUMINATION SYSTEM FOR FURNITURE, AND A BEDSTEAD OF TUBULAR CONSTRUCTION EMPLOYING THIS DEVICE

(76) Inventor: Patrick Lem Washburn, 10830 Warwick Blvd., Newport News, VA (US) 23601

( * ) Notice: Subject to any disclaimer, the term of this patent is extended or adjusted under 35 U.S.C. 154(b) by 4 days.

(21) Appl. No.: 09/911,311

(22) Filed: Jul. 23, 2001

(65) Prior Publication Data

US 2002/0126475 A1 Sep. 12, 2002

Related U.S. Application Data

(60) Provisional application No. 60/221,534, filed on Jul. 28, 2000.

(51) Int. Cl.[7] ..... F21V 33/00
(52) U.S. Cl. ..... 362/130; 362/127; 362/84
(58) Field of Search ..... 362/127, 130, 362/84, 228, 801

(56) References Cited

U.S. PATENT DOCUMENTS

| | | | | |
|---|---|---|---|---|
| 819,068 A | | 5/1906 | Ives | 362/130 |
| 1,298,362 A | | 3/1919 | Lewry | 362/130 |
| 2,290,866 A | | 7/1942 | Cunard | 362/130 |
| 2,744,186 A | | 5/1956 | Kamin | 362/130 |
| 4,947,298 A | | 8/1990 | Stephen | 362/130 |
| 5,515,251 A | | 5/1996 | Abke | 362/127 |
| 5,683,169 A | | 11/1997 | Lucas et al. | 362/130 |
| 5,712,558 A | * | 1/1998 | Saint-Cyr et al. | 323/322 |
| 5,918,932 A | | 7/1999 | Morrison et al. | 297/217.6 |
| 6,234,642 B1 | | 5/2001 | Bokamper | 362/130 |

FOREIGN PATENT DOCUMENTS

DE 19757230 A1 * 7/1999

* cited by examiner

*Primary Examiner*—Sandra O'Shea
*Assistant Examiner*—Hargobind Singh Sawhney

(57) ABSTRACT

The invention concerns a lighting system for furniture, in this case a bed fabricated of PVC pipe, which combines bedpost-mounted halogen illumination and under-bed electroluminescent illumination. The arrangement of the low-voltage lamps within the bed frame itself provides sufficient ambient lighting for the whole bedroom. This eliminates the need for other bedroom lighting such as table lamps or floor lamps, therefore conserving space. The touch switch feature makes turning on the lights extraordinarily convenient by allowing for operation while still in bed, by locating the touch pads on or near the headboard within easy reach. The dimmer feature adjusts the intensity of the lights for appropriate atmosphere and easy wake up lighting as opposed to typical harsh lighting first thing in the morning. Under lighting provides sufficient non-intrusive late-night visibility without interrupting sleep, in addition to the aesthetically pleasing "floating" appearance of the bed itself.

7 Claims, 3 Drawing Sheets

MULTIFUNCTIONAL ILLUMINATION SYSTEM FOR FURNITURE, AND A BEDSTEAD OF TUBULAR CONSTRUCTION EMPLOYING THIS DEVICE

CROSS-REFERENCE TO RELATED APPLICATIONS

This application claims the benefit of provisional application Ser. No. 60/221,534, filed Jul. 28, 2000.

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

This invention relates to furniture, specifically to a bed-lighting mechanism that significantly improves upon the safety, affordability, practicality, convenience, overall usable illumination and aesthetic qualities of all previous bed-lighting mechanisms, and can also be applied to other articles of furniture.

Ever since electric lighting was made available to the public, people have been developing it to be integrated into all types of furniture in a variety of ways, for a variety of purposes. Two good recent examples of this type of related art are U.S. Pat. No. 5,515,251, Abke 1996, and U.S. Pat. No. 5,918,932, Morrison 1999. While these and other related art pertaining to other types of furniture may be suitable for the particular purpose to which they address, none are as suitable for the purposes of the present invention as heretofore described.

A thorough analysis of related art reveals that a popular article of furniture to illuminate is the bed. Inventors have attempted to integrate lighting into headboards, footboards, side rails, ornamental finials atop bedposts, and the area under the bed. A safe, practical and convenient method of illuminating the bed and its immediate area would aid in caring for the sick, reading or working from a reclining position in bed, and many other bed-related activities needing illumination.

Many bed-light combinations have been developed for hospital or nursing use, and are highly complex in nature. This complexity is due to the fact that hospital beds need to be multi-functional. In addition to illuminating, the functionality needs to allow the user to call medical personnel, adjust the orientation of the mattress, etc. A recent example of this type of related art is the lighting for a bed in U.S. Pat. No. 6,234,642 to Bokamper, May 22, 2001. This was a hospital style bed incorporating a night light into the pre-existing moveable components driven by an electric motor, and provides for amplification of said light by employing a luminescent or light-conducting rod. Since this design relies on preexisting wiring, this invention cannot be applied to a standard residential bed lacking motor-driven functionality.

Related art dating back to 1906 shows that inventors have been working on bed-light combinations for residential purposes for almost a century. Most of the bed lighting found in this type of related art is aesthetically awkward and functionally cumbersome. This type of bed lighting does not harmonize with the bed on which it is mounted because it is made simply as an accessory, not as a design element. Many other examples of bed-light combinations attempted in the last hundred years failed in terms of safety, practicality, convenience, ease of use and overall appearance. The following examples are most illustrative:

The related art closest in concept to the present invention is U.S. Pat. No. 819,068, Ives, May 1, 1906. Wiring is run through the tubular metal bedposts of a four-post bed, and the spherical finials atop the posts are fitted with incandescent lamps. Although Ives' bed lighting arrangement was innovative for his time, modern technology allows for many improvements in safety, practicality, ease of manufacture, and aesthetic appeal.

The lighting for a bed in U.S. Pat. No. 1,298,362 to Lewry, Mar. 25, 1919 put incandescent lamps within small cutouts of the posts of a four-post bed. Lewry's lighting configuration fails to shed light efficiently and usefully. The specific locations of the lamps within the bedposts did not make the best use of the lamps' available light, casting intrusive shadows with only a limited amount of light for the bed's occupants.

The lighting for a bed in U.S. Pat. No. 2,290,866 to Cunard, Jan. 11, 1940 was an incandescent lamp that attached underneath the bed. This configuration is functionally inadequate because of its single location placement and use of an incandescent lamp, requiring a switch to turn it on and off.

The lighting for a bed in U.S. Pat. No. 2,744,186 to Kamin, May 1, 1956 was incandescent lamps attached to the tops of bed posts. This arrangement fails to make a bed-light integration both functional and attractive, as evidenced by its exposed wires and switches.

The lighting for a bed in U.S. Pat. No. 4,947,298 to Stephen, Aug. 7, 1990 was a series of incandescent light bulbs connected to the side rails of a bed powered by a mechanism initiated by pressure from the mattress. This too fails all of the functional standards for the lighting to be used by the occupant(s) of the bed because of the location of the lights.

The lighting for a bed in U.S. Pat. No. 5,683,169 to Lucas, et al., Nov. 4, 1997 was a bed featuring four fluorescent light tubes employed as bedposts. This arrangement is inappropriate for home use due to the many drawbacks of fluorescent lights, including the high voltage of fluorescent lighting, the need to replace ballast, the fragility of the light tube itself, the harsh quality of fluorescent light as opposed to other types of light, the high cost of fluorescent light, and the buzzing sound that fluorescent light makes when it is on.

BRIEF SUMMARY OF THE INVENTION:

As the discussion of the related art revealed, many beds have lights as secondary accessories (e.g., reading lights or track lighting), and some integrate light fixtures as part of the overall design. However, no related art uses light as a primary component in an inexpensive, safe, convenient, practical and aesthetically-pleasing manner. Further, no related art combines bedpost lighting with under-bed lighting, as does the present invention.

The present invention improves upon previous bed-light combinations by providing sufficient ambient lighting and non-intrusive safety lighting for the whole bedroom in a safe, convenient, attractive and practical manner. In this case, improvements to safety are made by using low-voltage halogen lamps. Further, many of the electrical components of the lighting system are concealed within the tubular structure of the bedstead itself, increasing the safety of the bed-light combination. The lights are oriented towards the ceiling so that the whole room is illuminated, not just the immediate area of the bed as in other bed-light combinations. The touch-switch feature allows for convenient operation of the halogen lights while still in bed, by locating the touch pads on or near the headboard within easy reach, instead of having to operate a switch. The dimmer feature allows for adjustment of the intensity of the halogen lights according to the user's needs. Under-lighting the bed using cool electroluminescent lamps provides non-intrusive night visibility for safety, without interrupting the sleep of others in the room. Additionally, the quality of the light emitted by the electroluminescent lamps gives the entire bed a "floating" effect.

An object of the present invention is to provide an aesthetically pleasing bed structure, easily adapted to any interior design theme, in a manner that does not expose the electrical components.

Another object of the present invention is to provide a novel, improved and unique bed-lighting mechanism that is of low cost to manufacture with respect to its materials and labor. Not only is the lighting arrangement less expensive than in previous iterations of the lighted bed, the substitution of PVC pipe for metal or hardwood makes a lighted bed less expensive to manufacture and therefore less expensive to sell. Manufacturers of this bed can pass that savings on to the consumer, who can then enjoy a lighted bed at an affordable price.

It is an advantage of the present invention that the halogen light fixtures embedded in the bedposts, oriented towards the ceiling, can fill the entire room with warm, natural-looking light.

Another advantage of the present invention is that the multi-level touch-dimmer switch adjusts the intensity of the halogen lights.

Another advantage of the present invention is that other lights (reading lights, table lamps, floor lamps) are no longer necessary in the bedroom. Since the halogen lamps reflect off the ceiling, the entire room is illuminated.

A further advantage of the present invention is that the electroluminescent lamps under the bed provide non-intrusive gentle illumination for navigation in a darkened room.

A further advantage of the present invention is that the electroluminescent lamps under the bed do not require any sort of switch to turn them on or off, but instead are continuously emitting cool illumination only visible after one's eyes have adjusted to the dark.

Other objects and advantages of the present invention reside in the novel construction and combination of parts to be hereinafter described and particularly pointed out in the claim, the nature of which will be readily apparent to those skilled in the art by reference to the accompanying drawings and descriptions.

BRIEF DESCRIPTION OF THE SEVERAL VIEWS OF THE DRAWING

This invention may be embodied in the form illustrated in the accompanying drawings, attention being called to the fact, however, that the drawings are illustrative only, and that changes may be made in the specific construction illustrated and described within the scope of the appended claims FIG. 1 comprises a side view of the bed and its light fixtures mounted atop the bedposts and under the bed.

REFERENCE NUMERALS IN DRAWINGS

Figure 1:
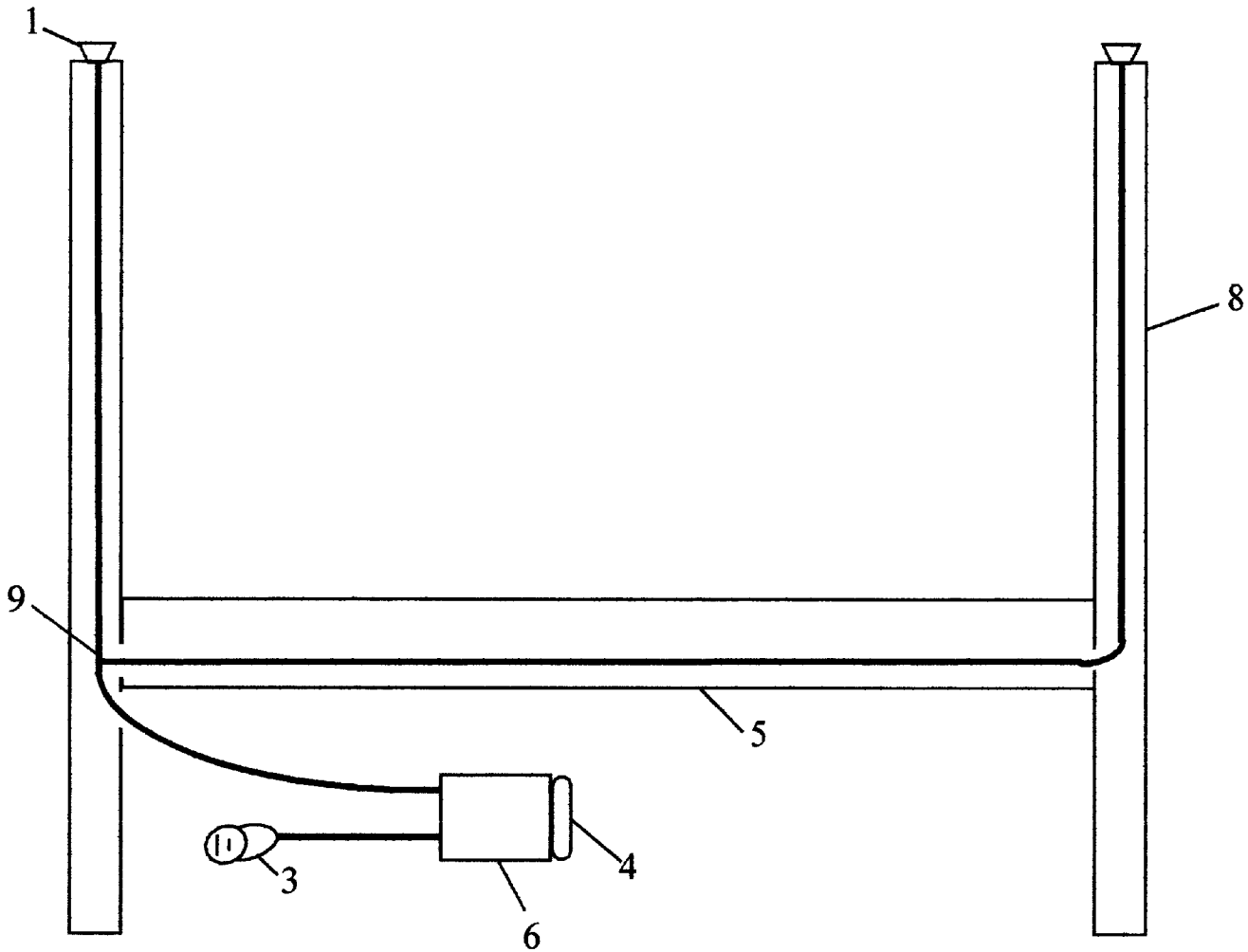
Figure 2:
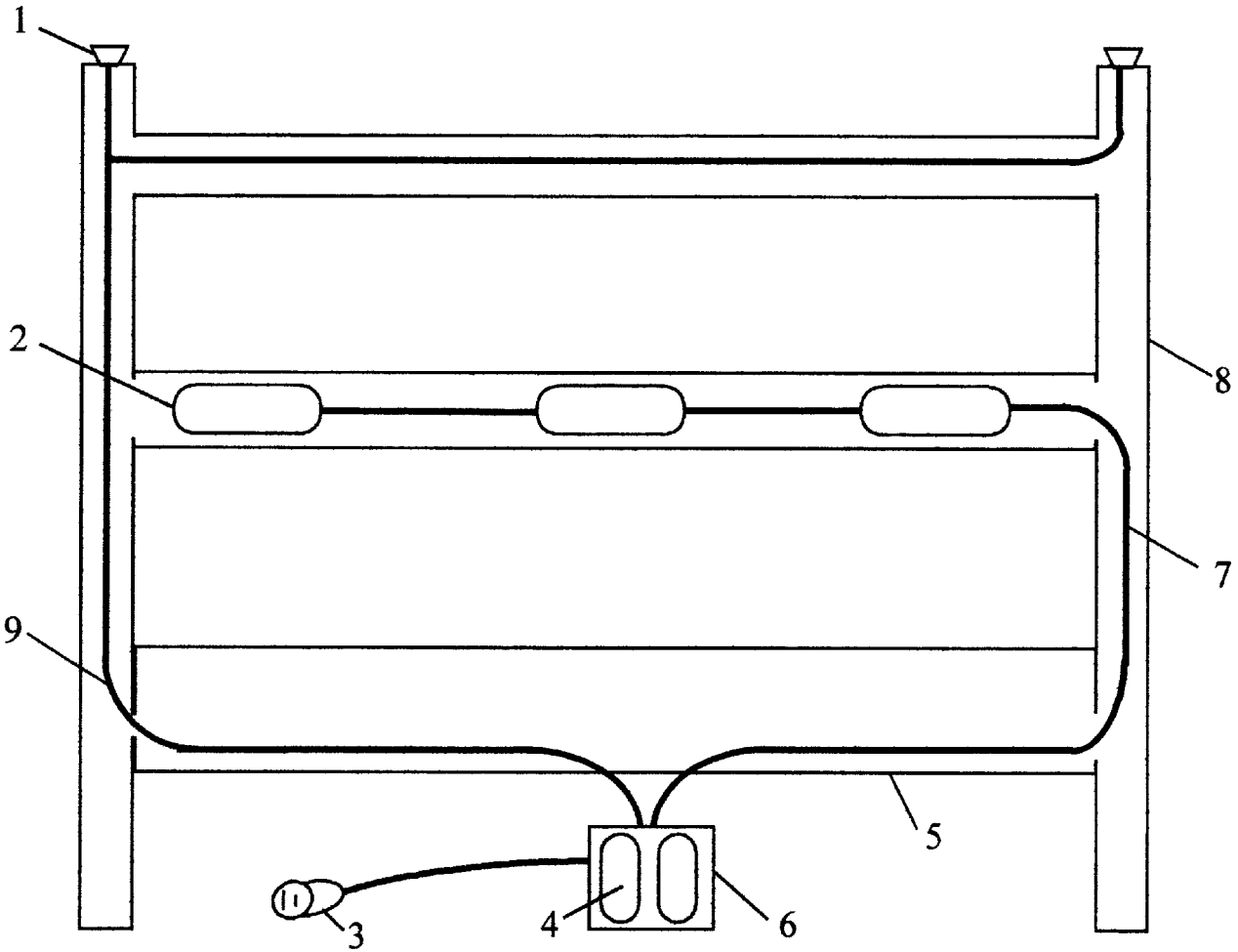
FIG. 2 comprises a side view of same.
Figure 3:
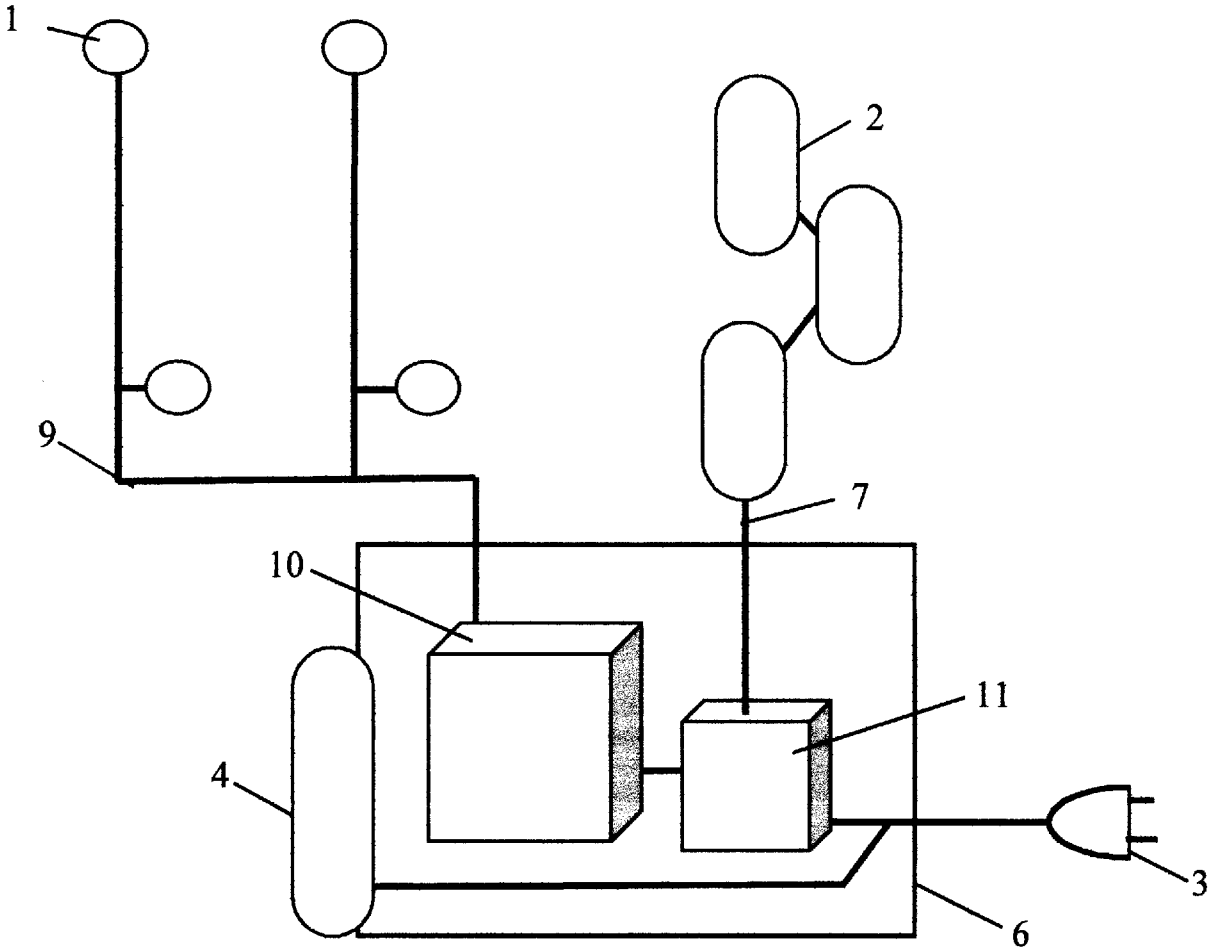
FIG. 3 is a schematic layout of both the halogen and electroluminescent light fixtures.

1. Halogen Bulb And Light Fixture Assembly
2. Decorative Metallic Touch Pad On Or Near Headboard
3. Power Cord And 2-Prong Plug (110V AC Household Current)
4. Electroluminescent Device
5. Wood Bed Frame
6. Electrical Enclosure For Housing Touch Switch And Transformer
7. Wire Connecting Touch Pad (2) To Touch Switch Located In Electrical Enclosure (6)
8. PVC Pipe Bedstead
9. Wire Harness For 12-Volt Power To Halogen Lights,
10. Power Transformer For Halogen Lights
11. Touch Switch (Dimmer)

DETAILED DESCRIPTION OF THE INVENTION

Preferred Embodiment

Given a standard mattress, a standard box-spring and a standard or custom-built bed frame (5), a bedstead (8) is assembled of PVC pipe, to comprise a headboard and footboard, and this bedstead is attached to the bed frame. When so attached, the bedstead forms a four-post bed. Each post has a halogen bulb and fixture assembly (1) located at the top end of the post, oriented toward the ceiling. Each light has a standard connector that attaches to a wire harness (9). This wire harness is routed through the headboard piping for aesthetic and protective purposes, and attaches to a standard 12 volt power supply (10). The power supply is controlled by a touch dimmer switch (11). The decorative touch pads (2) for the dimmer switch are located at the headboard and connected to the switch by wire (7). Underneath the bed are mounted multiple electroluminescent devices (4). A standard electrical enclosure (6) is located at the head of the bed frame. A standard power cord (3) connects to this electrical enclosure, which supplies power for the entire system.

Alternative Embodiments

Any tubular material can be used instead of PVC pipe to assemble the bedstead (8).

Any suitable light source, for example neon, light-emitting diode (LED), light pipes, fluid filled light guides or fiber optic cables, can be used in place of the halogen light fixture (1).

Any suitable object of translucent or transparent material may be added to light fixture (1) to simultaneously serve as housing for said lights and ornamental finials for the bedposts.

Any suitable object of conductive material may be employed as a touch pad (2) to activate the dimmer switch (11).

Any suitable switch mechanism, such as voice-activated or light beam switches, can be used in lieu of the dimmer switch (11).

Operation

To activate the halogen lights, one touches the decorative touch pad, activating the touch-dimmer switch. The first touch of the switch produces a low light. The second touch produces a light of medium intensity. The third touch provides light bright enough for the whole room. To turn the light off, one touches the decorative conductive metal member a fourth and final time. The electroluminescent lamps mounted under the bed need no activation beyond plugging the cord into the wall. As the room darkens and one's eyes adjust to the darkness, the electroluminescent lamps, which are always on, become visible.

The lighting device in this embodiment can be divided into two subsystems: Above Lighting and Under-lit Lighting. Both subsystems are powered, in parallel, from a electrical enclosure located under the bed. The electrical enclosure can be powered by any household 110 volt alternating current outlet.

For the Above Lighting subsystem, the 110 volt alternating current from the electrical enclosure is converted by transformers into 12 volt alternating current. A halogen bulb is located at the top of each of the 4 bed posts. A modified (1" to ½") reducing bushing is utilized in this embodiment as a lighting fixture. The bushing allows the halogen bulb to be concentric with respect to the 1" pipe of the bed post. The fixture also provides an air gap between the hot bulb and the plastic pipe. Hi-temp RTV adheres the bulb to the fixture that is then placed inside the post.

Conductive metal objects are placed within reach on the headboard and are touched to operate a 3 level touch dimmer switch. The dimmer switch regulates the 110 volt alternating current power (from the electrical enclosure) to the halogen light transformers. Therefore, the dimmer switch is electrically connected between the electrical enclosure and the halogen light transformers. The halogen lights (oriented toward the ceiling) provide indirect light sufficient for the entire bedroom (at fill brightness) and soft ("mood" or wake-up) lighting at dimmer settings.

The Under-lit Lighting subsystem in this embodiment is powered directly by 110 volt alternating current to the electroluminescent devices designed for continuous operation, therefore, no switch is necessary. Multiple electroluminescent devices provide illumination under the bed, for the purpose of late night visibility, as well as increasing the aesthetic value of the bed.

Although the description above contains many specificities, these should not be construed as limiting the scope of the invention but as merely providing illustrations of the presently preferred embodiment. Accordingly, the scope of the invention should be determined not by the embodiment illustrated, but by the appended claims and their legal equivalents.

It will be understood that each of the elements described above may also find a useful application in other types of methods differing from the type described above. While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A bedstead, comprising:

a headboard, footboard, and a plurality of bedposts, all fabricated of tubular material and a plurality of lights at the top of said bedposts that will serve to radiate illumination within a room, and a plurality of decorative members of translucent material to simultaneously serve as housing for said lights and ornamental finials for the bedposts, and a plurality of decorative members of conductive metal installed on the headboard and said decorative member all connected to a touch dimmer switch, and said bedstead attached to a standard bed frame or custom-constructed bed frame, and a plurality of electroluminescent lamps to be mounted under the bed, at points along the length and width of said bed frame, and a non-conductive electrical enclosure mounted under the bed to provide housing for a plurality of wiring for said lights, touch dimmer switch and other necessary electrical components.

2. The bedstead of claim 1 wherein said bedposts, headboard and footboard are assembled from lengths of Schedule 40 PVC pipe and fittings.

3. The bedstead of claim 1 wherein said bedposts, headboard and footboard are assembled from lengths of metal pipe and fittings.

4. a headstead comprising:

a headboard, footboard, and a plurality of bedposts;

a plurality of lights on the bedposts serving to radiate illumination within a room;

a plurality of decorative members of conductive material installed on one of headboard and bedposts, the decorative members all being connected to a switch;

the bedstead being attached to a bed frame;

a plurality of electroluminescent lamps located under the bedstead at points along the length and width of the bed frame; and a non-conductive electrical enclosure mounted under the bed frame to provide a housing for electrical wiring for the lights, lamps, and switch.

5. The bedstead of claim 4, wherein the switch is a touch dimmer switch.

6. The bedstead of claim 4, wherein the headboard, footboard, and bedposts are fabricated from tubular material.

7. The bedstead of claim 4, wherein the lights are located on top of the bedposts.

* * * * *